United States Patent [19]

Lundèn et al.

[11] Patent Number: 4,492,491

[45] Date of Patent: Jan. 8, 1985

[54] RAIN WATER ROOF OUTLET OR SIMILAR FOR A BUILDING

[75] Inventors: Risto Lundèn; Olavi Ebeling, both of Helsinki, Finland

[73] Assignee: Oy Kontekla, Helsinki, Finland

[21] Appl. No.: 382,120

[22] Filed: May 26, 1982

[30] Foreign Application Priority Data

Jun. 2, 1981 [FI] Finland ..... 811700

[51] Int. Cl.[3] ..... E02B 5/08; E03F 5/14; E04D 13/04

[52] U.S. Cl. ..... 405/119; 52/12; 210/163

[58] Field of Search ..... 405/118, 119; 52/12, 52/16; 210/163-166; 404/2, 4

[56] References Cited

U.S. PATENT DOCUMENTS

| | | | |
|---|---|---|---|
| 2,689,017 | 9/1954 | Schmid | 210/166 X |
| 2,970,697 | 2/1961 | Larson et al. | 210/163 |
| 3,367,070 | 2/1968 | Mitchell | 52/12 |
| 4,107,929 | 8/1978 | Ebeling et al. | 405/119 |
| 4,112,691 | 9/1978 | Ebeling et al. | 405/119 |
| 4,385,010 | 5/1983 | Bosne | 405/119 X |

FOREIGN PATENT DOCUMENTS

| | | | |
|---|---|---|---|
| 568171 | 1/1933 | Fed. Rep. of Germany . | |
| 41451 | 11/1969 | Finland . | |
| 913267 | 12/1962 | United Kingdom . | |
| 1178505 | 1/1970 | United Kingdom . | |
| 1216292 | 12/1970 | United Kingdom | 52/12 |

*Primary Examiner*—Cornelius J. Husar
*Assistant Examiner*—Nancy J. Stodola
*Attorney, Agent, or Firm*—Cushman, Darby & Cushman

[57] ABSTRACT

A rain water roof outlet for a building for conducting rain water from a roof as an airless flow, i.e. as a full water flow. The arrangement includes a vertical pipe which at its upper end is connected to a wider trough mounted at the level of the roof. In the trough, above the mouth of the vertical pipe, is mounted a lid, which by special formation of its shape or by means of additional elements is adapted to increase the friction against the water flowing towards the mouth of the vertical pipe. This friction counteracts the tendency of creating whirls in the water stream and thereby contributes to producing full water flow in the vertical pipe by preventing air entry. The lid is preferably a net.

6 Claims, 2 Drawing Figures

RAIN WATER ROOF OUTLET OR SIMILAR FOR A BUILDING

Figure 1:
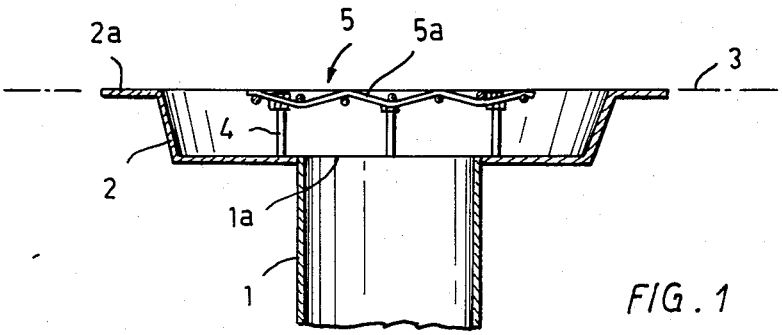

The present invention relates to a rain water roof outlet or similar, comprising a vertical pipe leading from a roof or some other collecting area, a trough connected to the upper end of said pipe, the free upper edge of said trough being located at a higher level than the mouth of the vertical pipe, and a lid fastened above the mouth of the vertical pipe, said lid being wider than the mouth but smaller than the trough in order to prevent the formation of an air whirl in the vertical pipe when the trough is filled with water.

From the Finnish Patent Specification No. 41451 there is previously known a rain water roof outlet operating according to the principle of solid water flow, i.e. wherein the flow of water in the vertical pipe takes place as an uniform airless water column across the entire cross-sectional area of the pipe. As rain water flows through the trough into the vertical pipe, a whirling flow is produced in the trough and at the mouth of the vertical pipe, and if air is permitted to freely enter together with the rain water into the mouth of the vertical pipe, a funnel-shaped air whirl is produced in the trough which causes the rain water to flow turbulently down the pipe along its inner periphery only. In order to prevent such an air whirl, a lid is mounted in the trough above the mouth of the vertical pipe. Said lid is either entirely unperforated or perforated to such a small extent only that air flowing through the lid is not yet able to produce an undesired air whirl in the trough.

In this known rain water roof outlet construction the lid is expressly mounted at a lower level than the upper edge of the trough so that the lid is located substantially below the water level when the trough is filled with water and the rain water outlet operates according to said solid water flow. The purpose of this is to ensure that the water quantity in the trough forms a sufficiently thick layer of water above the mouth of the vertical pipe so that the trough together with the lid forms a water lock which prevents the entry of air and the formation of an air whirl in the trough.

This known roof outlet construction is based on the idea of avoiding the formation of an air whirl by preventing entry of air into the formation area of the air whirl. A roof outlet based on such an operation, however, requires that the lid is located within the water layer formed in the trough and, moreover, that a fairly thick water layer remains on top of the lid when the trough is filled with water in order to prevent also the entry of air past the edge of the lid below the lid under the influence of the whirling flow of water. However, because of this, the trough must be made relatively high which hampers the positioning of the roof outlet in a roof because a high trough requires space in the roof structures.

It is an object of the present invention to provide a rain water roof outlet which eliminates the above-mentioned disadvantage and permits a solid water flow by means of a more advantageous construction. This object is achieved by a roof outlet according to the invention, which is based on the idea of avoiding the formation of an air whirl in the trough, not by preventing the air entry to the pipe mouth by the aid of a water lock, but by counteracting the creation of whirls in the water stream towards the vertical pipe mouth. A net-like lid will for instance serve the purpose of the invention, even if the total area of the net holes is greater than that of the lid perforation mentioned in the aforementioned Finnish Patent No. 41451. The condition being only that the lid prevents the formation of water whirls by efficient increasing of its friction function in the water stream.

Generally taken the arrangement according to the invention is characterized in that the lid has such a formation or is supplied by such elements as to increase the friction in the water passing the lid and flowing towards the mouth of the vertical pipe, whereby the tendency to form whirls in the water is counteracted. Even when using a netlike lid having a perforation substantially greater than the maximum allowable perforation in the roof outlet construction described in said Finnish Patent Specification, which still ensures a solid water flow, it is possible to efficiently prevent the formation of an air whirl as long as the lid provides a sufficient friction surface for preventing whirling in the trough. The lid may also be plate-like but, when using a smooth surface, a plate of a larger area is naturally required. The size, for example, the diameter of the lid is dependent on the water quantities in question, the size of the trough and the like, i.e. on how much friction the lid has to produce and how great circulating forces caused by the water are to be overcome by means of the lid.

Experiments made have proved that, when using a lid according to the invention which retards whirling of water, a substantially thinner water layer in the trough above the mouth of the vertical pipe is sufficient to ensure a solid water flow than what is required in the known roof outlet described above. The height of the water layer may be as small as about $\frac{1}{3}$ to $\frac{1}{4}$ of the diameter of the vertical pipe. The expression "at the water level when the trough is filled with water" refers to the level at which the surface of such a minimum water level is set in the trough when the roof outlet still operates by means of solid water flow.

In general, there is no reason to make the trough higher than what is necessary for ensuring the minimum water layer described above. Thus, the lid will be located in a roof outlet according to the invention at the level of the upper edge of the trough or only slightly below said level. Owing to this, the trough of the roof outlet is shallower than in the known roof outlet. The shallowness of the trough is a considerable advantage when mounting the outlet in a roof.

The lid may according to the invention be rigid or flexible. In the latter case, the lid will be able to follow any variations of the water level occurring in the trough and to apply, also under such circumstances, on the water layer the highest possible retarding effect.

Figure 2:
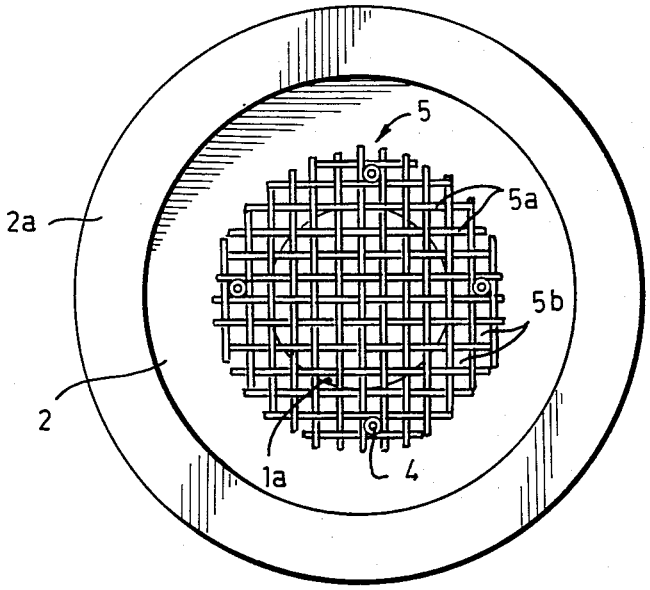

In the following, the invention will be described in more detail with reference to the accompanying drawing, in which FIG. 1 is an axial vertical section of a preferred embodiment of a roof outlet according to the invention, and FIG. 2 is a top view of the roof outlet.

The roof outlet shown in the drawing comprises a vertical pipe 1 having a mouth 1*a* at the upper end which is fastened centrally in the bottom of a trough 2 shaped as a truncated cone. The trough is intended to be mounted on the roof of a building so that the upper edge flange 2*a* of the trough is located at the level of the roof surface 3.

Centrally of the trough is by means of bolts 4 fastened a circular lid 5 so that the lid is located substantially at the level of the upper edge flange of the trough. The distance of the lid from the bottom of the trough is about $\frac{1}{3}$ of the diameter of the vertical pipe.

As best appears from FIG. 2, the lid is formed by a net comprising crossing threads 5*a* between which holes 5*b* are formed. Thus, the net has a very large number of holes. The underside of the net forms an uneven surface owing to the crossing threads.

The roof outlet operates in the following manner:

When the rainfall is not as heavy as the water quantity per unit of time for which the vertical pipe is dimensioned for obtaining a solid water flow and which the vertical pipe is able to discharge from a specific roof area as an airless water column, the trough will be only partially filled so that air is able to enter past the lid into the mouth of the vertical pipe. When the rainfall increases to the same amount as the above mentioned water quantity per unit of time, the trough will be filled with rain water up to the upper edge of the trough so that the surface of the water in the trough contacts the underside of the lid. Without the lid, the water would have a tendency to circulate in the trough around a vertical axis while flowing to the mouth of the vertical pipe so that an air whirl would be formed in the centre of the water layer. Said whirl would allow entry of air into the mouth and, accordingly, prevent the formation of a solid water flow. However, the rough underside of the net applies on the water layer in the trough such a high retarding effect counteracting said circulation that the water is prevented from getting into circulation. Because of this, no air whirl will be produced in the water layer although the net in no way as such prevents air from passing through the net. Owing to the net, the roof outlet thus operates by means of solid water flow. It will be noted that the trough is very shallow.

The drawing and the associated description are only intended to illustrate the idea of the invention. In details, the roof outlet according to the invention may vary within the scope of the claims. Thus, instead of a rigid structure, the lid may be made flexible so that it is able to follow small oscillations and waves in the water surface. Instead of a permeable net or similar, a completely or nearly unpermeable plate may be used as lid, the underside of said plate being rough or provided with downwardly projecting stops, such as ribs, or the like. The underside of the plate may also be smooth, in which case the size of the plate must be correspondingly enlarged to provide a sufficiently large friction surface in the plate. If necessary, the lid may be connected to a litter screen. The shape of the lid is to some extent dependent on the shape of the trough, and in some cases the friction surface of the lid may be downwardly convex.

What we claim is:

1. A rain roof outlet for a building comprising: a vertical drain pipe leading from a roof having a roof line, a trough arranged in the roof and adapted to collect water from the roof, the trough having a bottom and side walls which have upper edges in line with the roof line, the drain pipe having an upper end forming a mouth which is connected with the bottom of the trough so as to drain the water collected in the trough from the roof; and means for retarding circumferential whirling of water about the axis of the axis of the drain pipe as the water enters the mouth of the drain pipe, said means being a lid in the form of a net having a large number of perforations, and having a rough lower surface, said net being located substantially at the roof line and providing a resistance to circumferential flow of water through and along the surfaces of the net thereby creating full flow of water into said mouth.

2. A roof outlet as in claim 1 wherein the area of the perforations of the net is greater than the perforation of a lid causing a solid water flow but permitting circulation of water in the trough.

3. A roof outlet as in claim 1 wherein said net is rigid.

4. A roof outlet as in claim 1 wherein said net is flexible.

5. A roof outlet as in claim 1 wherein the distance of the lid from the mouth of the vertical pipe is about $\frac{1}{3}$ to $\frac{1}{4}$ of the diameter of the vertical pipe.

6. In a rainwater outlet system for a roof having a roof line: a trough having a bottom and side walls which have upper edges in line with the roof line; a vertical drain pipe having an upper end forming a mouth which is connected to the bottom of the trough; a net formed of cross filaments forming between them a large number of perforations, the cross filaments forming a rough and uneven lower surface of the net, said net being arranged directly above the drain pipe mouth at the level of the upper edges of the trough side walls, there being a space between said net and the drain pipe mouth which is essentially unobstructed to permit water flow from the trough into the mouth, the area of the net being greater than the area of the mouth, the distance between the net and the mouth being about $\frac{1}{3}$ to $\frac{1}{4}$ the diameter of the mouth whereby the trough is relatively shallow, and the rough, uneven lower surface of the net serving to increase friction to the extent that water flowing under the net and into the mouth, when in contact with the lower surface of the net, is prevented from swirling about the axis of the mouth thereby creating full water flow into the mouth and thereby permitting the trough to be relatively shallow.

* * * * *